US005729198A

United States Patent [19]

Gorman

[11] Patent Number: 5,729,198

[45] Date of Patent: Mar. 17, 1998

[54] WIRELESS RESIDENTIAL DOOR UNLATCH SYSTEM

[76] Inventor: Kim Ramsey Gorman, 810 S. Curve St., Alexandria, Ind. 46001

[21] Appl. No.: 735,978

[22] Filed: Oct. 25, 1996

[51] Int. Cl.[6] ..... G08B 1/08

[52] U.S. Cl. ..... 340/539; 70/279; 70/280

[58] Field of Search ..... 70/279, 280, 281, 70/282, 283; 292/144, 254; 340/539

[56] References Cited

U.S. PATENT DOCUMENTS

| | | | |
|---|---|---|---|
| 328,030 | 10/1885 | Henzel | 292/54 |
| 351,600 | 10/1886 | Henzel et al. | 292/54 |
| 352,154 | 11/1886 | Rousseau | 70/279 |
| 393,282 | 11/1888 | Wildt | 292/144 |
| 508,518 | 11/1893 | Johnson | 70/92 |
| 518,119 | 4/1894 | Schnepf | 70/92 |
| 1,805,451 | 5/1931 | Keil | 292/254 |
| 3,677,043 | 7/1972 | Cox | 70/92 |
| 3,998,483 | 12/1976 | Yan | 292/254 |
| 4,005,885 | 2/1977 | Austin, Jr. | 292/144 |
| 4,496,942 | 1/1985 | Matsuoka | 340/696 |
| 4,561,116 | 12/1985 | Neyret | 455/603 |
| 4,679,834 | 7/1987 | Gotanda | 292/169.13 |
| 4,722,116 | 2/1988 | Erickson | 16/49 |
| 4,881,148 | 11/1989 | Lambropoulos et al. | 361/172 |
| 4,907,429 | 3/1990 | Davis et al. | 70/279 |
| 5,109,221 | 4/1992 | Lambropoulos et al. | 340/825.69 |
| 5,149,157 | 9/1992 | Laugery et al. | 292/241.16 |
| 5,219,196 | 6/1993 | Luker | 292/341.16 |
| 5,246,258 | 9/1993 | Kerschenbaum et al. | 292/144 |
| 5,263,347 | 11/1993 | Allbaugh et al. | 70/257 |
| 5,372,394 | 12/1994 | Salter et al. | 292/92 |
| 5,474,342 | 12/1995 | Smith et al. | 292/254 |

*Primary Examiner*—Jeffrey Hofsass
*Assistant Examiner*—Daryl C. Pope
*Attorney, Agent, or Firm*—Woodard, Emhardt, Naughton Moriarty & McNett

[57] ABSTRACT

Described is a preferred wireless system for unlatching the door of a residence. The system includes a solenoid/strike plate assembly controlled by a receiver unit which in turn is controlled by RF or other electromagnetic signals. The preferred system is readily retrofit into existing residential structures with a single bore into the door jamb into which the solenoid/strike plate assembly is mounted, and includes a minimum of moving parts.

16 Claims, 4 Drawing Sheets

WIRELESS RESIDENTIAL DOOR UNLATCH SYSTEM

BACKGROUND OF THE INVENTION

The present invention relates generally to systems to assist in opening doors, and in particular to a radio frequency-operated system for unlatching a door of a residence and thus allowing for "hands free" passage through the door.

As further background, various systems have been proposed to assist in the ingress and egress into and out of buildings or other similar structures. For example, U.S. Pat. No. 328,030 describes an electric bolt releasing device in which a locking/unlocking mechanism is built into the face plate mounted on the door frame. The mechanism includes an electromagnetically operated keeper which in a locked position does not allow the swinging passage of the bolt and in an unlocked position can be pushed aside by the swinging passage of the bolt. Similarly, U.S. Pat. No. 351,600 to Hensel et al. describes an electromagnetic door opener in which the bolt engages a notch in a rotary detent mounted in the jam. A locking bar is associated with the detent, and locks and releases the rotary detent by the electromagnetically-controlled action of an armature.

U.S. Pat. No. 352,154 to Rousseau describes still another door opener device which includes a lockable/unlockable detent mounted in the door jam. A door opener employing an electromagnetically-operated keeper head in the jamb which engages the door latch is described in U.S. Pat. No. 393,282. U.S. Pat. No. 508,518 to Johnson describes another system in which a latch block on the jamb side engages the latch in a locked condition and can be electromagnetically released.

U.S. Pat. No. 518,119 to Schnepf describes a pneumatically-controlled door lock opener in which a striking plate lever on the jamb side can be released by the action of bellows responding to fluid injected therein. The lever then yields to the passing door latch. U.S. Pat. No. 1,805,451 to Keil describes another system in which a jam-side latch block member is electromagnetically-operable to a locked condition preventing passage of the latch and an unlocked condition in which the latch is allowed to slip by.

U.S. Pat. No. 4,679,834 to Gotanda describes a door unlock system which includes a pushing member which moves the latch bolt out of the strike when a solenoid is energized, whereby the door may be opened without rotating the door knob. In the Gotanda system, the pusher member is L-shaped and is triggered by a complex mechanism mounted in the jamb side of the door.

U.S. Pat. No. 5,474,342 to Smith et al. describes another system in which a pusher element is electrically controlled to push a latch bolt into a retracted position. Smith et al. describe primarily systems in which the pusher elements function on a rotating basis. One system described in Smith et al. includes two solenoids each of which has a plunger. A first plunger is extended to lock the latch, and retracted to unlock the latch. The second plunger is extended to push the latch into a retracted position.

In light of the foregoing background, there still exist needs for wireless door unlatching systems which are simple in design and readily retrofittable, and include minimal moving parts and convenient RF controllability. The present invention addresses these needs.

SUMMARY OF THE INVENTION

Accordingly, one preferred embodiment of the present invention includes a wireless system for hands-free opening of a residential door. In accordance with the invention the system includes a door mounted in an opening of a residence, the door having a latch having an extended position for placing the door in a closed, latched condition, and a retracted position for placing a door in a closed, unlatched condition from which the door can be pivoted open. The latch is spring biased to the extended position, and the door has a handle which is manually operable to overcome the spring bias of the latch to convert the door from its closed, latched condition to its closed, unlatched condition. The system of the invention further includes a door jamb adjacent the opening and, mounted in the door jam, a wireless solenoid/strike plate assembly for converting the door from its closed, latched condition to its closed, unlatched condition without manually operating the handle. This assembly includes a strike plate having an opening for receiving the door latch in its extended position, and for releasing the door latch in its retracted position. The assembly further includes a solenoid unit having a push rod and arranged such that when the solenoid is energized with the door in its closed, latched condition, the push rod extends into the opening of the strike plate, overcomes the spring bias of the door latch, and forces the same to its retracted position thereby placing the door in its closed, unlatched condition. On the other hand, when the solenoid is de-energized, the spring bias of the door latch is sufficient to move the push rod to a retracted position and to secure the door in its closed, latched condition. The system of the invention also includes the receiver unit operably associated with strike/solenoid assembly and operable to energize the solenoid upon receiving a predetermined electromagnetic wave signal, and to de-energize the solenoid in the absence of the signal. A transmitter is also provided and is adapted to transmit the predetermined electromagnetic wave signal when actuated. In the manner, a user of the system can unlatch the door by manually operating the handle, or by actuating the transmitter to allow hands-free opening of the door.

Another preferred embodiment of the invention provides a kit for retrofitting a door of a residence with a wireless door unlatch system, which includes a remotely-operable solenoid/strike plate assembly which includes a strike plate having an opening for receiving the door latch when in its extended position, and for releasing the door latch when in its retracted position. The assembly further includes a solenoid unit attached to the strike plate having a push rod arranged such that when the solenoid is energized, the push rod extends into the opening of the strike plate with sufficient force to overcome the spring bias of the door latch of the door being retrofitted, but when the solenoid is de-energized the spring bias of the door latch is sufficient to push the push rod to a retracted position thus allowing the door latch to catch in the strike plate. The kit also includes a signal receiver unit which can be associated with the strike/solenoid assembly so as to energize the solenoid upon receiving a predetermined electromagnetic wave signal, and to de-energize the solenoid in the absence of the signal. In addition, the kit includes a transmitter adapted to transmit the electromagnetic wave signal when actuated.

Still a further embodiment of the invention provides a solenoid/strike plate assembly useful for retrofitting a door to make the same remotely unlatchable. The assembly includes a strike plate having an opening for receiving a door latch for the door when the door latch is in its extended position, and for releasing the door latch when in its retracted position. The assembly further includes a solenoid unit attached to the strike plate and having a push rod arranged such that when the solenoid is energized the push rod extends into the opening of the strike plate with sufficient force to overcome the spring bias of the door latch.

It is an object of the present invention to provide a door unlatch system which can be conveniently retrofitted into existing residential doors.

It is another object of the invention to provide a wireless door unlatch system which is simple and inexpensive in design and installation, and possesses a minimum of moving parts. It is a further object of the invention to provide a wireless door unlatch system which is conveniently controlled by radio frequency, and allows a user to signal a receiver associated with a door unlatch mechanism so as to unlatch the door, whether locked or not, and allow the door to be pushed open without manually turning or otherwise operating the handle of the door.

Additional embodiments, objects, features and advantages of the invention will be apparent from the following description.

DESCRIPTION OF THE PREFERRED EMBODIMENTS

Figure 1:
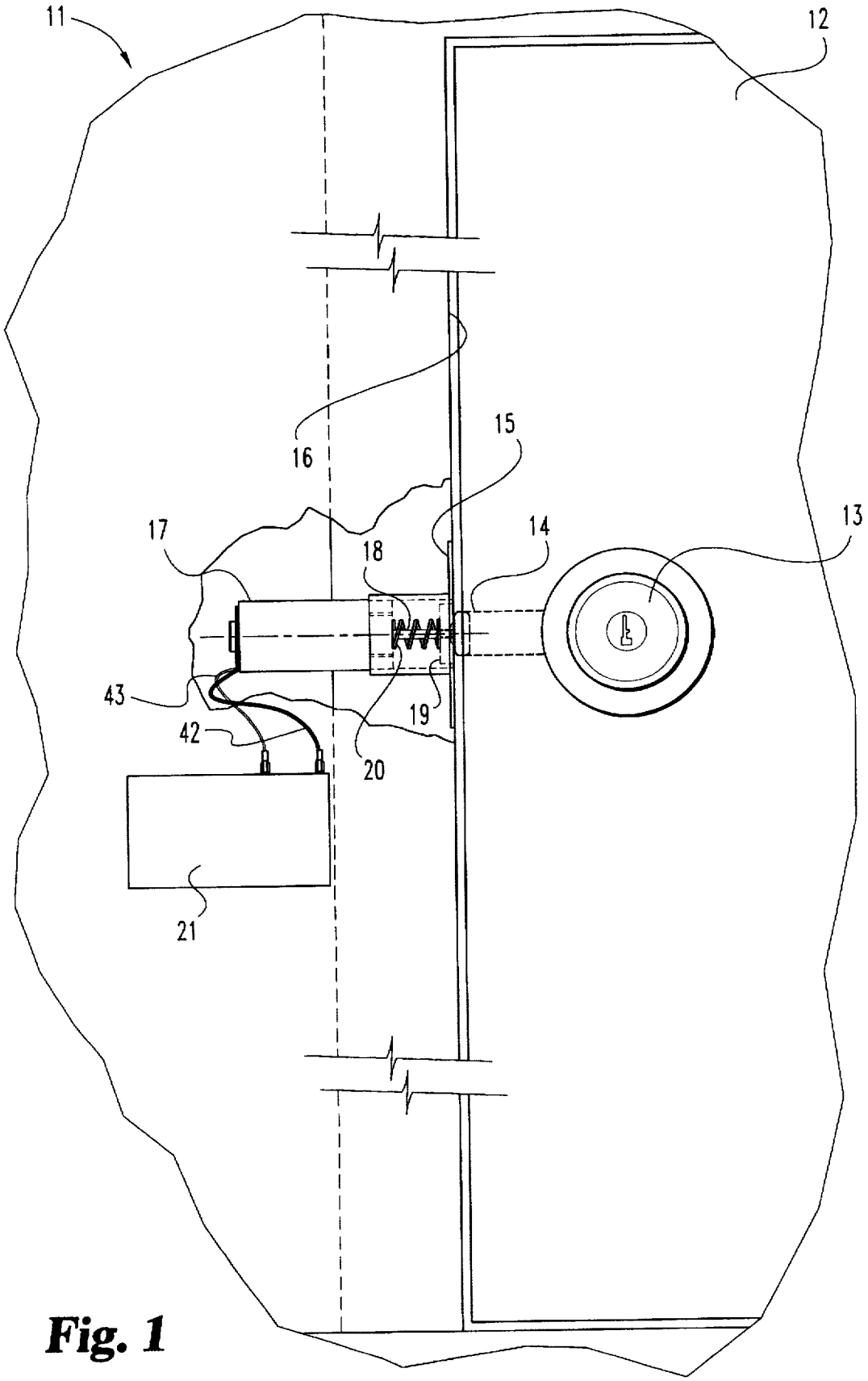
FIG. 1 provides a perspective, cutaway view of a wireless door unlatch system of the invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, shown is a wireless door unlatch system 11 of the invention. System 11 generally includes a door 12 of a residence or other like building, having a door handle 13. Door handle 13 is operably associated with latch 14, which is spring biased to an extended position for securing the door in its latched, closed position. Rotation of handle 13 overcomes the spring bias of latch 14, thus retracting latch 14, unlatching the door 12 and allowing the same to be pivoted to an open position. In this regard, latch 14 cooperates with strike plate 15 mounted in door jamb 16 for latching and unlatching operations. In particular, in a latched position, latch 14 extends into an opening of strike plate 15, thus securing the door against pivot from its closed position. On the other hand, when latch 14 is in a retracted position, it clears the opening of strike plate 15 such that the door can be pivoted open.

In accordance with the invention, system 11 also includes a solenoid/strike plate assembly 17 including a solenoid having push rod 18. In a preferred embodiment, attached at the end of push rod 18, via threads or the like, is engagement plate 19, preferably circular in cross section. The preferred assembly also includes spring 20 mounted over rod 18 in between the body of the solenoid and the engagement plate 19. Spring 20 assists in the overall smooth operation of the assembly 17, and can assist the solenoid in forcing the latch 14 to its retracted position.

The system 11 also generally includes a control box 21 which can, for example, be mounted on an interior wall of the residence, adjacent the door. Control box 21 includes electronics which in conjunction with a transmitter control the energization/de-energization of solenoid 17 via leads 42 and 43, as discussed hereinbelow.

Figure 2:
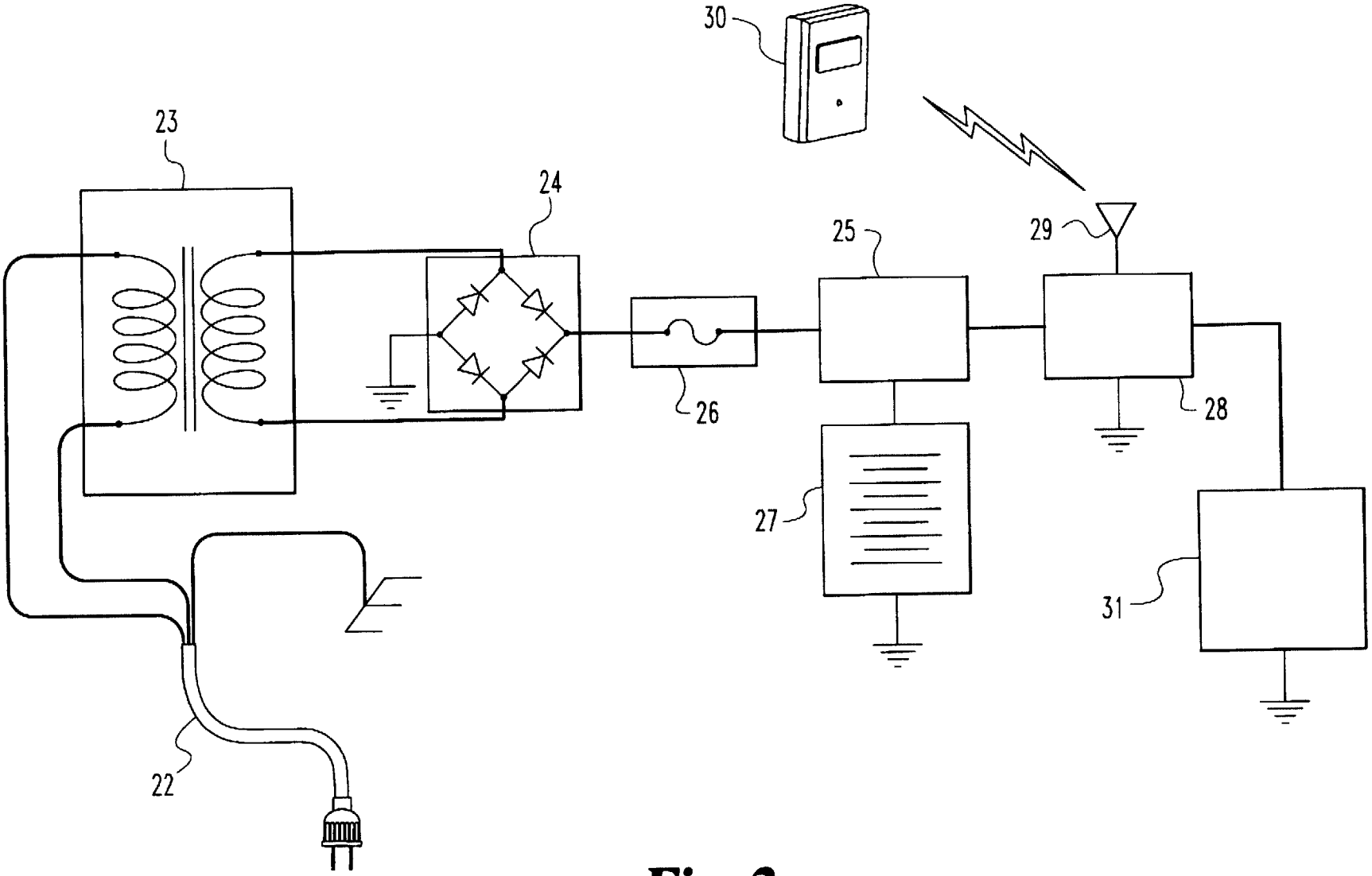
FIG. 2 provides a circuit diagram of a system of the invention.

Referring now to FIGS. 1 and 2 together, shown in FIG. 2 is a circuit diagram of illustrative electronics contained in the control box 21 of FIG. 1. A standard three-prong cord 22 is operably coupled to a step-down transformer 23 with an output voltage of about 16 volts. The output of transformer 23 is operatively coupled to a full wave rectifier 24 having an output of about 12 volts. The full wave-rectified DC output from rectifier 24 is operatively coupled to a charger circuit 25 with an intervening fuse 26. Charger circuit 25 is operable to charge backup battery 27. After charger circuit 25 the 12 volt full wave-rectified supply is operatively coupled to receiver relay 28 with antenna 29. Receiver relay 28 is adapted to receive an RF signal from a wireless remote transmitter 30 and during the period over which the signal is being received-to energize the solenoid 31. In this manner, a user of the system can signal with transmitter 30, and system 11 will unlatch door 12 such that the user can push the door open without the need to turn handle 13. It should be noted in this regard that the remote signal from transmitter 30 will unlatch door 12 regardless of whether the door is in a locked or unlocked condition, as in spring latched devices commonly used today, latch 14 can be pushed to its retracted position regardless of the locked or unlocked condition of the door 12. It will be understood that the control circuit used in the present invention may also have other features, for example including a timer which causes the solenoid to be energized for a predetermined period of time upon receipt of a signal from the transmitter.

Figure 3:
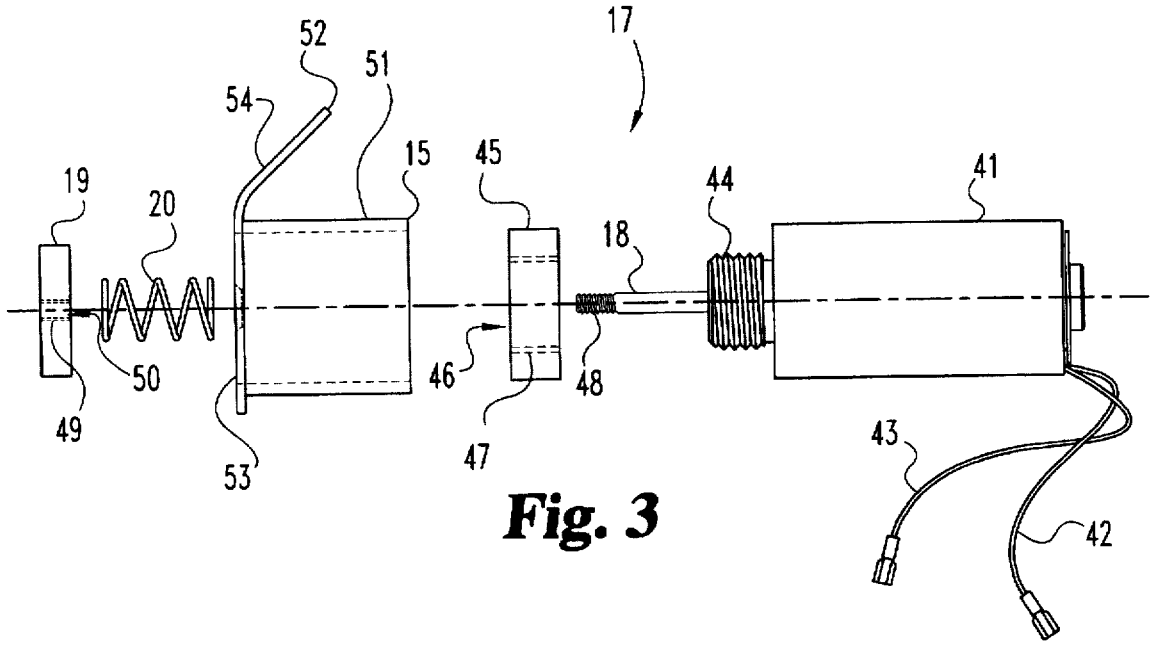
FIG. 3 provides an exploded side view of a solenoid/strike plate assembly of the invention.
Figure 4:
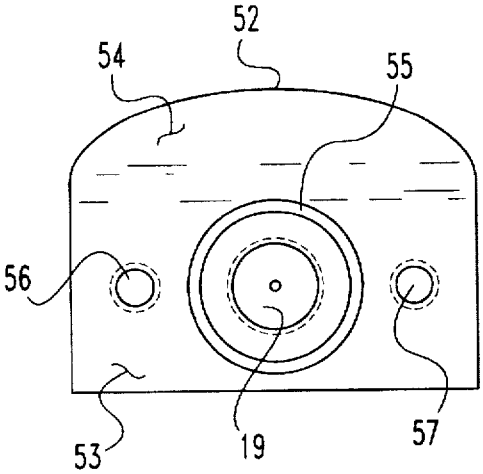
FIG. 4 provides a front view of a solenoid/strike plate assembly of the invention.
Figure 5:
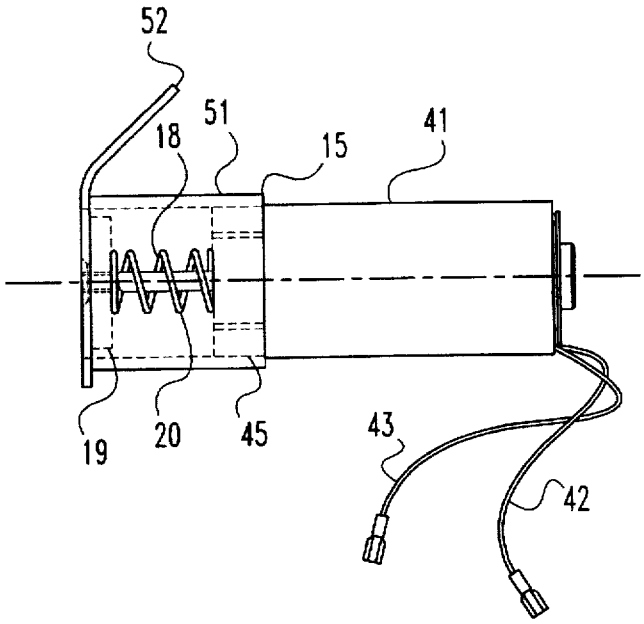
FIG. 5 provides a side view of a solenoid/strike plate assembly of the invention.

Referring now to FIGS. 3–5, shown is a preferred solenoid/strike plate assembly 17 useful in systems of the invention. Assembly 17 includes a solenoid generally having solenoid body 41 electrically connected to leads 42 and 43. Solenoid body 41 includes a threaded shoulder 44, and a reciprocating push rod 18 as previously described which extends and retracts along an axis. A threaded member 45 having opening 46 with threads 47 is also provided. Threaded shoulder 44 of solenoid body 41 is threadable into threads 47 of member 45 so as to engage the same.

Threads 48 are also provided on end of push rod 18, which threads 48 are adapted to threadedly engage threads 49 of bore 50 of engagement plate member 19. Assembly 17 also includes strike plate 15 having a generally cylindrical body 51, and a face member 52. Face member 52, in turn, has a first wall portion 53 adapted to be coplanar with the door jamb surface in which assembly 17 is installed, and a second wall portion 54 which is angled from first portion 53 and which serves to guide a latch of a door into the opening of strike plate 15 to secure a door in a latched position. In constructing assembly 17, member 45 is attached, e.g. pressure fit or bonded, to the inner walls of body 51 of strike plate 15 (FIG. 5), and threaded shoulder 44 is threaded into threads 47 of member 45. From the open end of strike plate 15 (left side, FIGS. 3 and 5), spring 20 is fed over rod 18 and engagement plate 19 is threaded onto threads 48 of rod 18. This results in the completed assembly, best illustrated in FIG. 5. Generally, in this assembly, the axis of the cylindrical body 41 is substantially perpendicular to the portion 53 of the strike plate adapted for flush mounting to the door jamb, to enable retrofit into a horizontal bore in the jamb.

Referring now particularly to FIG. 4, additional details of strike plate 15 can be seen. Strike plate 15 includes a generally smooth, tapered area 55 about its central opening, so as to facilitate slippage of the latch 14 out of strike plate 15, for example when opening a door. Strike plate 15 also includes bores 56 and 57, for attaching assembly 17 to the door jamb with screws or the like.

Figure 6:
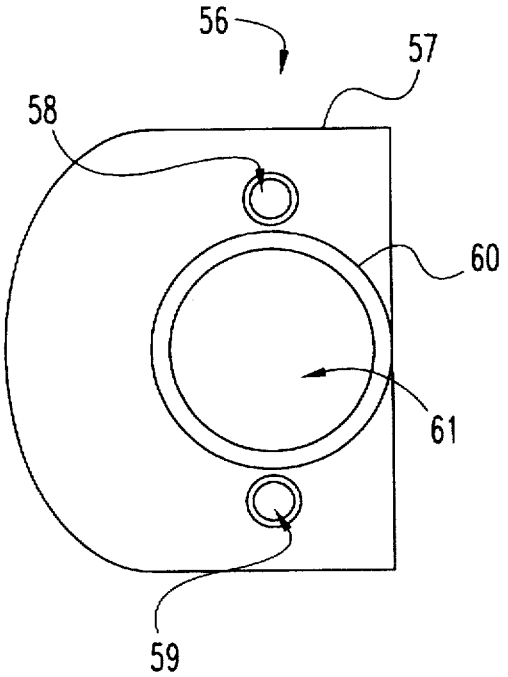
FIG. 6 provides an end view of a boring guide useful in kits of the invention to facilitate retrofit of systems of the invention and to existing doors.
Figure 7:
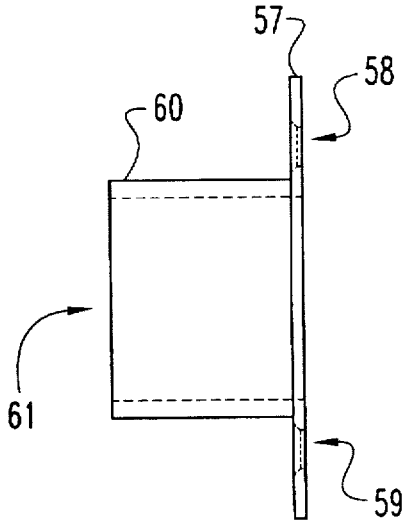
FIG. 7 provides a side view of the guide of FIG. 6.

Referring now to FIGS. 6 and 7, shown is a bore guide 56 which can be used to facilitate installation of a solenoid/strike plate assembly 17 in systems of the invention. Bore guide 56 includes a generally planar body 57 having bores 58 and 59 which are in registry with bores 56 and 57 of strike plate 15 (FIG. 4). Guide 56 also includes a collar portion 60 having a central opening 61 which has an inner diameter which closely approximates the outer diameter of body 51 of strike plate 15. In this fashion, guide 56 can be affixed to the door jamb at the location of installation, for example by screws passed through bores 58 and 59, and can serve to guide a boring device such as a drill or the like to optimize the direction and position of the bore in the door jamb into which solenoid 41 is to be installed. Kits of the invention may also include a drill bit such as a spade bit having a diameter substantially equal to the inner diameter of central opening 61 of bore guide 56, for boring the hole in the door jamb. An illustrative installation of a system of the invention will now be described in more detail.

In a retrofit, the existing strike plate mounted to the door jamb can be removed. Guide 56 can then be affixed to the door jamb as described, and a device such as a drill with a boring bit can be used to create a horizontal bore in the door jamb at a sufficient depth to receive solenoid/strike plate assembly 17 such that wall portion 53 of strike plate 15 will reside substantially flush with the surface of the door jam. Bore guide 56 can then be removed. Solenoid/strike plate assembly 17 is then fed into the bore in the door jam, and affixed to the door jamb via bores 56 and 57 of strike plate 15, for example by screws. Control box 21 is mounted to an interior wall of the residence adjacent the door 12. If necessary, leads 42 and 43 of assembly 17 can be fished behind drywall or the like to the location of the control box 21 and electrically connected. Control box 21 can then be plugged into a standard power outlet of the residence and any dry wall or other necessary structural repairs affected, to complete installation of the system.

It is contemplated that systems of the invention can be conveniently sold in kits, including a solenoid/strike plate assembly, a control box and a transmitter as previously described. In addition, such kits can include a bore guide as previously described to assist in the installation, and appropriate instructions, etc. In this regard, the spring bias on latches of various doors, including interior and exterior access doors, varies to some extent. It will therefore be advantageous to include in such kit springs (20, FIG. 1) of varying strength, and thus such kits may have a plurality of such springs. For instance, exterior door latches generally have spring biases greater than interior door latches, and thus stronger springs 20 may be used in conjunction with installations in exterior doors. On the other hand, springs supplying less force can be used on interior doors where the spring bias of latches is generally of lesser magnitude.

It is also contemplated that systems of the invention can be installed in new construction, can be installed in one or multiple doors of the home, each independently operable (e.g. at differing frequencies) or each operable at the same frequency, and can include backup batteries to continue to supply power to the system in the event of a power failure in the outlet providing power to the control box.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A wireless system for hands-free opening of a residential door, comprising:

a door mounted in an opening of a residence, the door having a latch having an extended position for placing the door in a closed, latched condition, and a retracted position for placing the door in a closed, unlatched condition from which the door can be pivoted open, the latch being spring-biased to the extended position; the door further having a handle manually operable to overcome the spring bias of the latch to convert the door from its closed, latched condition to its closed, unlatched condition;

a door jamb adjacent the opening and, mounted in the door jamb, a remotely-operable solenoid/strike plate assembly for converting the door from its closed, latched condition to its closed, unlatched condition without manually operating the handle, the assembly including:

a strike plate having an opening for receiving the door latch when in its extended position, and for releasing the door latch when in its retracted position;

a solenoid unit having a push rod and arranged such that when the solenoid is energized with the door in its closed, latched condition, the push rod extends into the opening of the strike plate, overcomes the spring bias of the door latch and forces the same to its retracted position thereby placing the door in its unlatched condition, and when the solenoid is de-energized the spring bias of the door latch is sufficient to move the push rod to a retracted position and secure the door in its closed, latched condition;

a signal receiver unit operable to energize the solenoid upon receiving a predetermined electromagnetic wave signal, and to de-energize the solenoid in the absence of the signal; and a transmitter adapted to transmit the electromagnetic signal when actuated;

whereby a user of the system can unlatch the door by manually operating the handle or by actuating the transmitter to allow hands-free opening of the door.

2. The system of claim 1, wherein the electromagnetic signal is a radio frequency signal.

3. The system of claim 2, which is operable to energize the solenoid during a period over which the signal is transmitted.

4. The system of claim 2, which is operable to energize the solenoid for a predetermined period of time upon receipt of the signal.

5. The system of claim 2, wherein the push rod has an end with an engagement plate attached thereto, and a spring is received over the push rod and contacts the engagement plate to assist in overcoming the spring bias of the latch.

6. The system of claim 1, wherein said solenoid unit has a solenoid body and said push rod reciprocates to and from said extended position of said push rod along an axis of said solenoid body.

7. The system of claim 6, wherein said axis of said solenoid body is generally parallel with an axis along which said door latch moves between its retracted and extended positions.

8. The system of claim 7, wherein said axis of said solenoid body and said axis along which said door latch moves are generally co-axial.

9. A kit for retrofitting a residence door with a wireless door unlatch system, the residence door having a latch which is spring-biased in an extended position, the kit comprising:

a solenoid/strike plate assembly including a strike plate having an opening for receiving the door latch when in its extended position, and for releasing the door latch when in its retracted position; and a solenoid unit attached to the strike plate and having a push rod arranged such that when the solenoid is energized the push rod extends into the opening of the strike plate with sufficient force to overcome the spring bias of the door latch, and when the solenoid is de-energized the spring bias of the door latch is sufficient to move the push rod to a retracted position;

a receiver unit for electrical connection to the striker/solenoid assembly and when so connected operable to energize the solenoid upon receiving a predetermined electromagnetic signal, and to de-energize the solenoid in the absence of the signal; and a transmitter adapted to transmit the electromagnetic signal when actuated.

10. The kit of claim 9, wherein the electromagnetic signal is a radio frequency signal.

11. The kit of claim 10, wherein the receiver unit is operable to energize the solenoid during a period over which the signal is transmitted.

12. The kit of claim 10, wherein the push rod has an end with an engagement plate attached thereto, and a spring is received over the push rod and contacts the engagement plate to assist in overcoming the spring bias of the latch.

13. The kit of claim 12, which includes a plurality of said springs of varying strength.

14. The kit of claim 13, which includes a bore guide member for facilitating boring a door jamb for installation of the solenoid/strike plate assembly.

15. A solenoid/strike plate assembly useful in a wireless system for unlatching a spring-biased latch of a door of a residence, comprising;

a strike plate having an opening for receiving the latch when in the latch is in its extended position for placing the door in a closed, latched condition, and for releasing the latch when the latch is in its retracted position; the strike plate further having means for attachment to a door jamb;

a solenoid unit attached to the strike plate and having a push rod arranged such that when the solenoid is energized the push rod extends into the opening of the strike plate with sufficient force to overcome the spring bias of the latch, and when the solenoid is de-energized the spring bias of the latch is sufficient to move the push rod to a retracted position.

16. The assembly of claim 15, wherein the push rod has an end with an engagement plate attached thereto, and a spring is received over the push rod and contacts the engagement plate to assist in overcoming the spring bias of the latch.

* * * * *